United States Patent [19]

Switzer

[11] 4,313,275

[45] Feb. 2, 1982

[54] CARTRIDGE LOADER

[76] Inventor: Robert D. Switzer, 149 Highview Dr., Ft. Thomas, Ky. 41075

[21] Appl. No.: 109,286

[22] Filed: Jan. 3, 1980

Related U.S. Application Data

[63] Continuation-in-part of Ser. No. 905,855, May 15, 1978, Pat. No. 4,202,124.

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 1,480,812 | 1/1924 | Bazan | 42/89 |
| 3,722,125 | 3/1973 | Switzer | 42/89 |
| 4,065,868 | 1/1978 | Johnson | 42/89 |
| 4,202,124 | 5/1980 | Switzer | 42/89 |

*Primary Examiner*—Charles T. Jordan

*Attorney, Agent, or Firm*—Wood, Herron & Evans

[57] ABSTRACT

An improved cartridge loader of the type having a generally star shaped latch that cooperates with cartridge bores positioned within a casing. A first novel feature is a semi-automatic rotation device for the star shaped latch, which device causes rotation of the latch from a cartridge capturing position to a cartridge releasing position in response to an external force directed axially against a knob when the casing is restrained against rotational motion, and which device will not induce rotation of the latch unless the casing is so restrained. The semi-automatic rotation device is also manually operable to set the latch from the releasing position to the capturing position, and to return the latch from the capturing position to the releasing position, simply by manually rotating the knob. A second novel feature of this improved cartridge loader incorporates a resilient but stationary bore closure member that, preferably, defines a circular contact locus radially outward of the locus of points established by the cartridge bores' center axes. In one embodiment of this second feature the resilient closure member is normally out of contact with the cartridges, and in another embodiment of this second feature the resilient closure member is normally in contact with the cartridges, when the casing is filled with cartridges and positioned upright.

12 Claims, 20 Drawing Figures

CARTRIDGE LOADER

This application is a continuation-in-part application of U.S. application Ser. No. 905,855, filed May 15, 1978, now U.S. Pat. No. 4,202,124.

This invention relates to cartridge loaders. More particularly, this invention relates to a novel and improved cartridge loader structure.

Cartridge loaders are, of course, very well known to the art. Cartridge loaders of one structure or another have been around for many, many years, and are shown in the early patent art as well as in the recent patent art. One main type of cartridge loader structure, in the commercial marketplace, is particularly designed for use with revolvers. Revolvers are normally loaded by hand, the five or six chambers of the revolver's cylinder being manually loaded one cartridge at a time. Basically, a cartridge loader functions to retain five or six cartridges temporarily in storage. When reloading of the revolver is required, the cartridge loader with stored cartridges is interposed in operational relation with the revolver's cylinder, and all 5 or 6 cartridges released simultaneously into that cylinder. Quite obviously, the concept of a cartridge loader materially increases the speed with which a revolver can be loaded and re-loaded, and greatly facilitates the loading of that revolver, by a user.

One type of cartridge loader that has been significant commercial success in the marketplace is that structure illustrated in U.S. Letters Pat. No. 3,722,125, issued March 27, 1973, and invented by the inventor of the improved cartridge loader of this application. The cartridge loader illustrated in that patent is basically comprised of a casing and a star shaped latch structure fixed in place on a centerpost, the centerpost (and, hence, the latch structure) being rotatable relative to the casing. The casing is provided with a plurality of cartridge bores aligned parallel to the centerpost's axis for retaining cartridges in temporary storage in the loader. The casing's bores are of a length shorter than the cartridges to be stored therein, so the cartridgess' nose ends extends beyond one casing end face when stored within the bores. The star shaped latch includes a plurality of star points and a stop groove that cooperate with the casing's bores and the cartridges' flanges for alternatively capturing and releasing the cartridges depending on the rotational position of that latch. The rotational limits of the latch structure (and, hence, of the centerpost) are defined by a spring biased ball detent that cooperates with stop structure for locating the rotational position of the shaft in either the capturing or releasing position only. The latch structure (and, hence, the centerpost) is rotated between capturing and releasing positions by manually gripping a knob fixed to the centerpost.

In this known prior art cartridge loader structure, and as mentioned, the latch structure must be manually rotated into the releasing position for accepting a new charge of cartridges in the cartridge loader and, thereafter, must be manually rotated to the capturing position for retaining those cartridges in temporary stored configuration within the loader's casing. Subsequently, and when it is desired to quickly charge a revolver's cylinder with cartridges in the loader, the latch structure must be manually rotated from the capturing position to the releasing position after the cartridges have been preliminarily inserted in the revolver's cylinder. In other words, and with the cartridge loader structure shown in U.S. Pat. No. 3,722,125, the loader's latch structure must be rotated by hand so as to release a previously stored cartridge load from the loader into a revolver chamber, as well as to retain or latch a new cartridge load in place within the loader when that new load is inserted into the loader. It has been found in the field that, under certain circumstances, even this limited manual rotation step of the U.S. Pat. No. 3,722,125 cartridge loader during the unloading or releasing step is relatively time consuming from a user's standpoint. The extra time required for manual rotation in the release step may be disadvantageous to the user under certain use conditions, e.g., competition shooting, where maximum speed is required.

Further, and because of the structure of the loader's latch structure, i.e., the centerpost's star shaped points and stop groove, the tolerances required to make the U.S. Pat. No. 3,722,125 cartridge loader practical and operable from a commercial standpoint are such that the cartridges may tend to jiggle substantially once stored or captured in that cartridge loader. In other words, cartridges stored in this prior art cartridge loader tend to rattle within the casing's bores if the cartridge loader is shaken. This jiggle or rattle obviously generates a noise which, under certain use conditions, may be undesirable. The noise is created from the rattle type contact of the cartridges' shafts with the casing bores' side walls at that casing face from which the cartridges partially extend.

Accordingly, it has been one objective of this invention to provide an improved cartridge loader in which cartridges temporarily stored within the loader may be selectively released from that stored relation either by manually rotating the loader's latch knob from the retaining position to the releasing position, or by exerting an external force axially against the loader's knob.

It has been a further objective of this invention to provide an improved cartridge loader in which cartridges temporarily stored within the loader are automatically released in response to an external force presented axially against the loader's knob, but which cannot release the cartridges in response to that axial force unless the cartridges are simultaneously restrained against rotational movement such as, e.g., by being partially inserted in a revolver's chamber.

It has been still a further objective of this invention to provide an improved cartridge loader in which a novel bore closure member and star latch structure cooperate to retain stored cartridges in a substantially non-jiggling attitude for reducing the noise created by stored cartridges rattling against the loader's casing, yet allows nominal unopposed movement of the cartridges' nose ends relative to the loader's casing for aiding initial cartridge insertion into a revolver's cylinder when loading that cylinder.

It has been another objective of this invention to provide an improved cartridge loader in which a resilient bore closure member defines a first circular locus of points for contact with stored cartridges' flanges, the first locus being disposed radially outward of a second circular locus of points that includes the axes of the loader's cartridge bores, the resilient closure member overlying the cartridges' firing pins to prevent inadvertent or accidental contact with those pins, and to cushion any shock to the cartridges' flanges, if the loader is accidentally dropped.

In accord with these objectives, the improved cartridge loader of this invention is directed to an improved cartridge loader of the type having a generally star shaped latch rotatably carried within a casing, the casing defining a plurality of cartridge bores positioned circumferentially around the latch. Upon rotation of the latch, the latch and each cartridge bore cooperate by alternately capturing and releasing a cartridge's flange within that bore for loading and unloading cartridges therefrom. A first novel feature of this improved loader is a semi-automatic rotation device for the star shaped latch, which device induces rotation of the latch from the capturing position to the releasing position in response to an external force directed axially against the loader's knob when the casing is restrained against rotational motion, e.g., when the cartridges in the casing are disposed in an unload attitude relative to a revolver cylinder, and which will not induce that rotation of the latch unless the casing is so restrained for preventing accidental release of stored cartridges if the loader is dropped or otherwise subjected to an undesirable external force on the loader's knob. The semi-automatic rotation device is also manually operable to re-set the latch from the releasing position to the capturing position, and to activate the latch from the capturing position to the releasing position, simply by manually rotating the loader's knob. In a preferred form of the semi-automatic rotation device, the knob is connected to a centerpost through a spring loaded cam structure, the star shaped latch being immobily fixed to the centerpost. A second novel feature of this improved cartridge loader incorporates a resilient but stationary bore closure member that, preferably, defines a circular contact locus radially outward of the cartridge bores' circular center axes locus. The latch and bore closure member cooperate to minimize jiggling of cartridges stored within the casings' bores for reducing undesirable noise, and, when the casing is dropped, to cushion any shock transmitted to the cartridges' flanges and to protect the cartridges' firing pins. In one embodiment, the resilient closure member is normally out of contact with the cartridges to allow nominal unopposed jiggling movement of the cartridges' nose ends relative to the casing for aiding initial cartridge insertion into a revolver's cylinder when loading the cylinder, and in another embodiment the resilient closure member is normally in contact with the cartridges to prevent that nominal unopposed jiggling movement. In a preferred form, the closure member is defined by a one-piece multi-fingered washer type structure coaxially located, and fixed in position, relative to the casing, the resilient fingers overlying the casing's bores at the cartridge flange end thereof.

Further objectives and advantages of this invention will be more apparent from the following detailed description taken in conjunction with the drawings in which.

Figure 1:
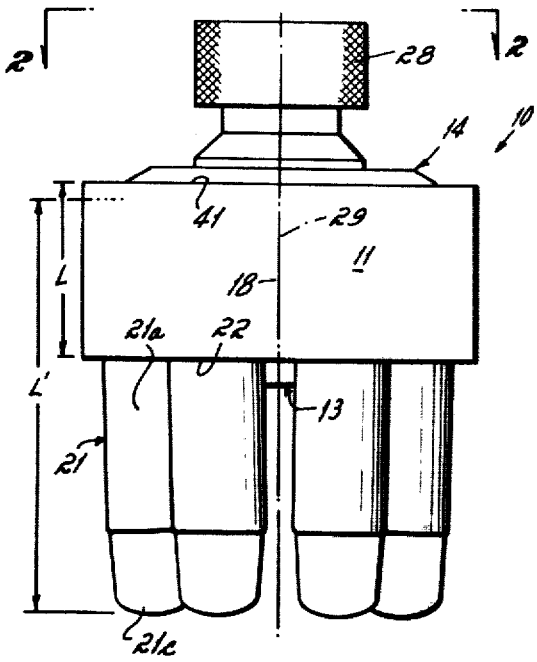
FIG. 1 is a side elevational view illustrating a first embodiment of an improved cartridge loader in accord with the principles of this invention, the loader being shown with a cartridge load in temporary stored or captured relation therewith.
Figure 2:
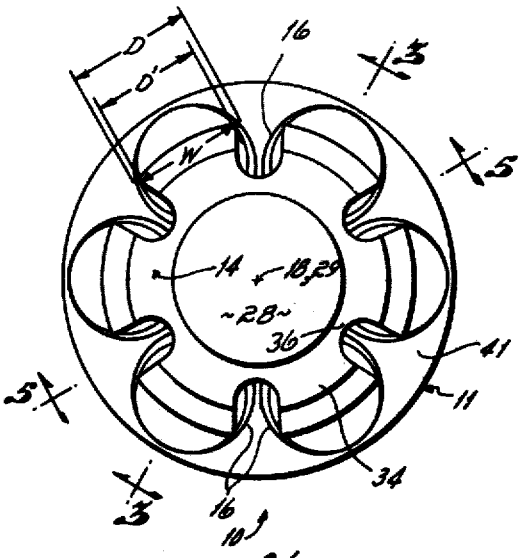
FIG. 2 is a top view of the loader illustrated in FIG. 1, and taken along line 2—2 of FIG. 1.
Figure 4:
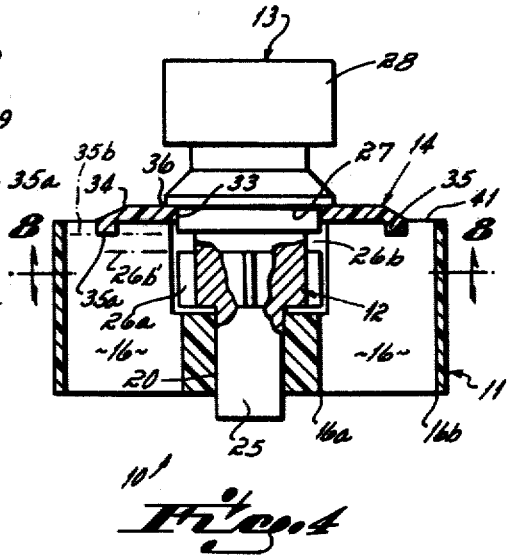
FIG. 4 is a longitudinal cross-sectional view similar to FIG. 3, but with the cartridges released from temporary stored relation with the cartridge loader, i.e., with the cartridge loader in the recharging/releasing position where the loader can be recharged with a new cartridge load.
Figure 5:
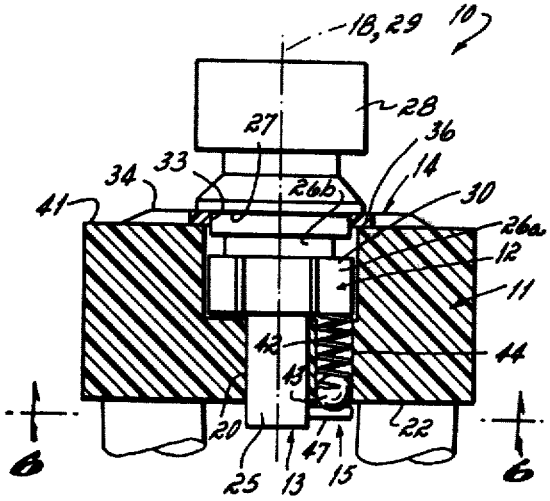
FIG. 5 is a longitudinal cross-sectional view taken along line 5—5 of FIG. 2.
Figure 6:
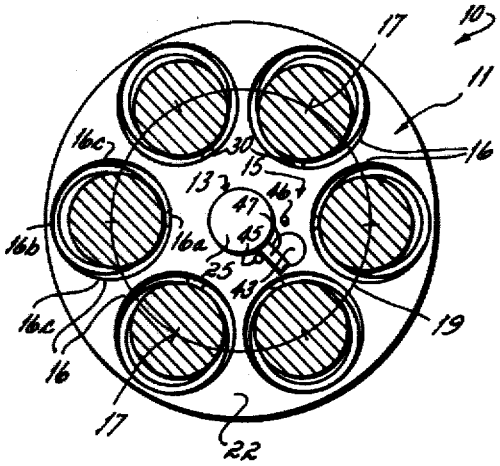
FIG. 6 is a bottom view of the loader shown in FIG. 1, and taken along line 6—6 of FIG. 5.
Figure 7:
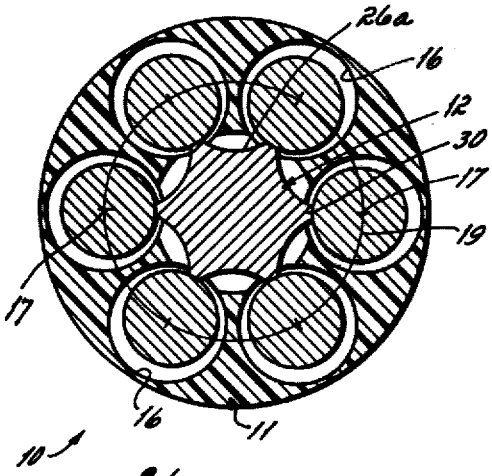
FIG. 7 is a transverse cross-sectional view taken along line 7—7 of FIG. 3.
Figure 8:
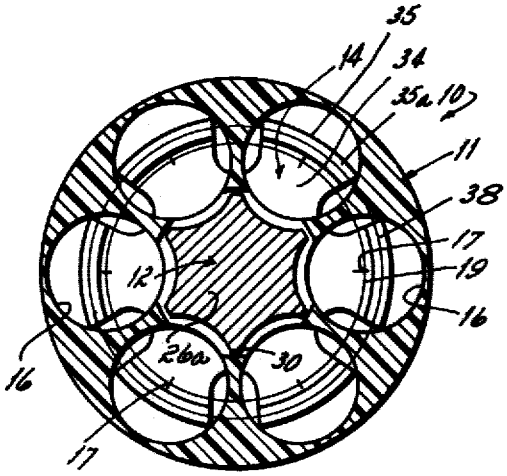
FIG. 8 is a tranverse cross-sectional view taken along line 8—8 of FIG. 4.

The first embodiment of an improved cartridge loader in accord with the principles of this invention is particularly illustrated in FIGS. 1-8. As shown in those figures, the improved cartridge loader 10 basically comprises a casing 11, a star shaped latch 12 on a centerpost 13 rotatably disposed within that casing, a resilient bore closure member 14, and an over-center type limit stop device 15 that defines the rotational limits for the centerpost. The casing 11 itself is comprised of six cartridge throughbores 16 as illustrated in FIG. 8. The six cylindrical throughbores 16 are each of the same diameter, and each define a longitudinal center axis 17, the axes being disposed parallel one to another and parallel to the casing's longitudinal axis 18. The center axes 17 of the bores 16, when viewed from the top or bottom as shown in FIGS. 2 and 6, are disposed on a circular locus of points 19 having as its center the center axis 18 of the casing 11. The casing 11 also includes a center or bearing bore 20 adapted to receive the centerpost 13 in rotational relation therewith. Note that the length L of the casing is significantly less, i.e., about only one-half as long as, the length L' of the cartridge 21 to be temporarily stored therein, thereby causing the cartridges' shafts 21*a* to extend beyond bottom end face 22 of the casing 11, see FIG. 1. Further, the diameter D of each of the casing's bores 16 is only very slightly greater than the diameter D' of each of the cartridge's end flanges 21*b*, e.g., 0.444 inches for bore diameter D and 0.437 inches for cartridge flange diameter D', see FIG. 2.

The centerpost 13 is comprised of a bearing shaft portion 25, a star shaped latch shaft portion 26*a* (i.e., a latch shaft portion that is star shaped in cross-sectional configuration), a latch groove portion 26*b* above latch shaft 26*a*, a washer seat section 27, and a knob 28, all being fixed integral one with another and formed from the same material piece, and all being symmetrically disposed on centerpost axis 29 that is coaxial with the casing's axis 18. Specifically, the bearing shaft portion 25 is received in bearing relation with bearing bore 20 of the casing so as to permit rotation of the centerpost 13. The star ribs 30 of the latch shaft portion 26*a* are dimensioned, relative to the location of the bores 16 in the casing 11, so as to intersect or be positioned in the cartridge bores 16 when the latch 12 (and centerpost 13) is disposed in the capture position shown in FIG. 7, and so as to be removed from or positioned out of those bores 16 when the latch 12 (and centerpost 13) is in the release attitude illustrated in FIG. 8.

Figure 3:
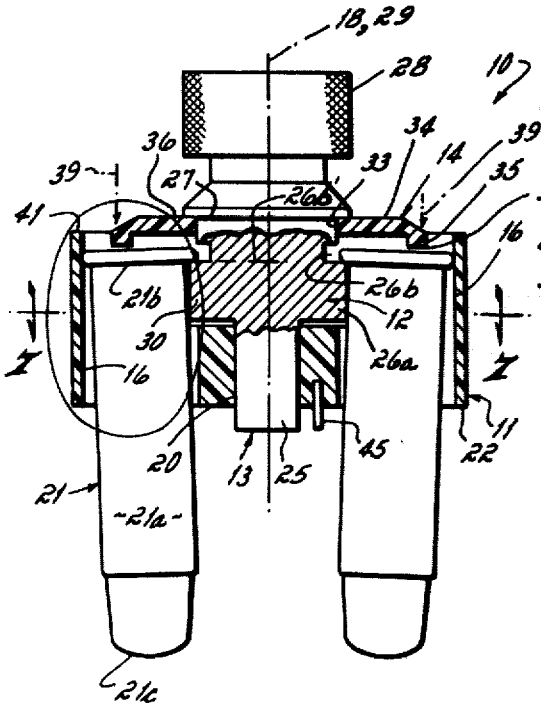
FIG. 3 is a longitudinal cross-sectional view taken along line 3—3 of FIG. 2.
Figures 3A, 3B:
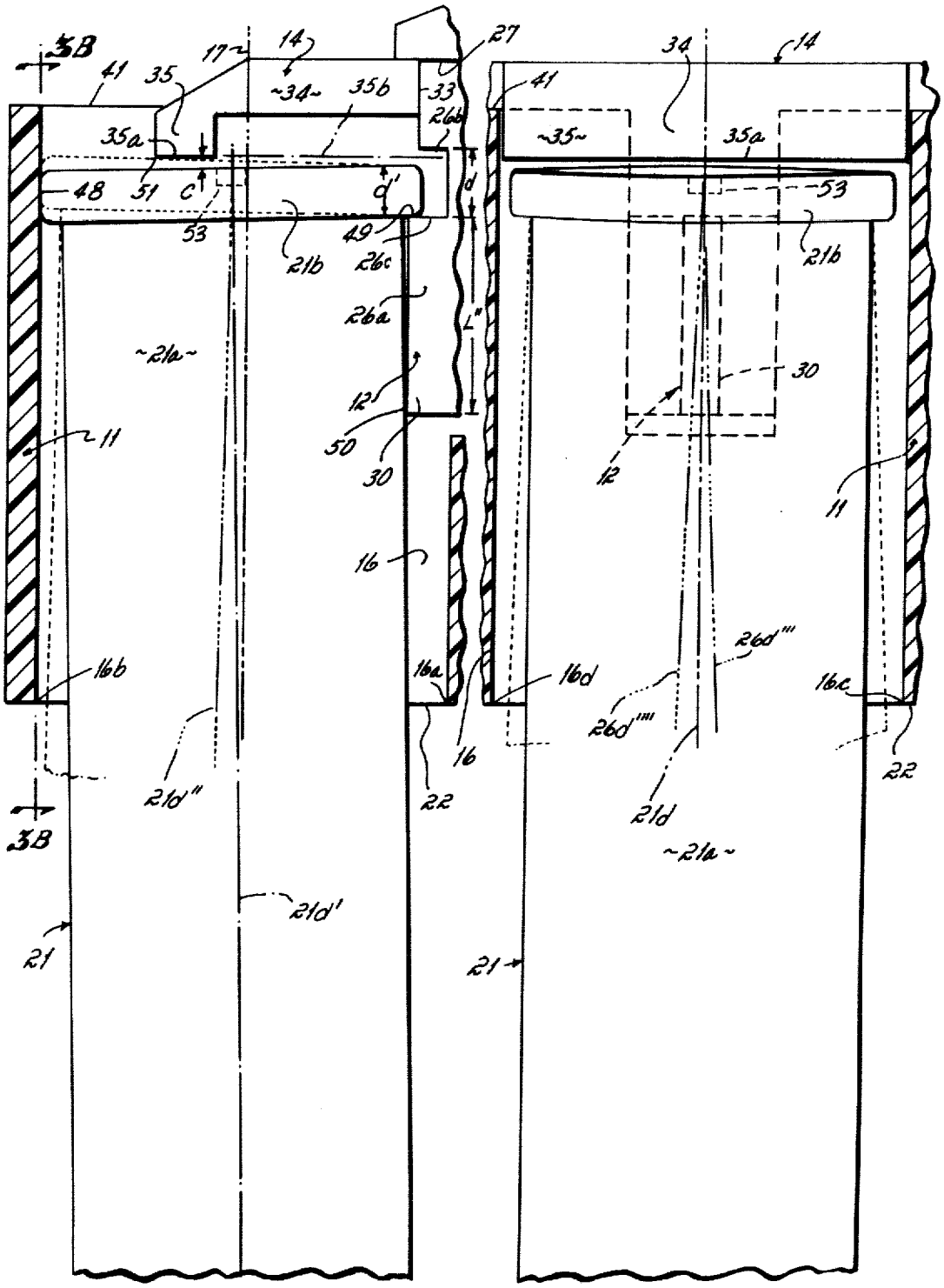
FIG. 3A is an enlarged view of encircled portion 3A of FIG. 3.
FIG. 3B is a cross-sectional view taken along lines 3B—3B of FIG. 3A.

Note particularly in connection with the star shaped latch shaft 26*a*, and as shown in FIG. 3 and 3A, that the top ends of the star ribs 30 terminate in latch groove 26*b*, the ribs 30 and latch groove 26*b* being particularly sized and configured to cooperate with the sidewalls of bores 16 for capturing flanges 21*b* of cartridges 21, thereby temporarily storing the cartridges 21 within the cartridge loader as discussed in greater detail below. In this regard, note the depth d of groove 26*b* is slightly greater than the thickness d' of a cartridge flange 21*b*, e.g., 0.070 inches for groove depth d and 0.055 inches for flange thickness d', for cooperation as discussed in greater detail below to minimize jiggling of cartridges 21 in the bore 16, see FIGS. 3, 3A and 3b. Also note particularly the length L'' of the star shaped latch shaft section 26*a* i.e., of the star ribs 30, which length L'' is also for the purpose of minimizing the cartridge jiggling in bores 16 as described in greater detail below. The centerpost 13 also defines an inverted seat 27 sized to receive the resilient bore closure member 14 in seated relation thereon. The free end of the centerpost shaft includes knob 28 having a knurled surface, the knob permitting the centerpost 13 and, hence, the latch 12, to be rotated between capturing and releasing positions by manually gripping the knurled surface thereof.

The resilient but stationary bore closure member 14 is particularly illustrated in FIGS. 2, 3A and 4, and includes a central bore 33 sized to permit interengagement of that member with inverted seat 27 on the centerpost 13. The fit between the bore closure member 14 and the centerpost 13 is a slip fit, and is sized to permit rotation of the centerpost relative to that member 14. The bore closure member 14 is comprised of a number of resilient protective arms 34 equal to the number of cartridge bores 16 in the casing 11. The protective arms 34 are defined in the one-piece member 14 to extend outwardly from washer section 36 so as to permit substantially independent action of each arm 34 relative to the bore 16 served by that arm, see FIG. 2. Note the washer section 36 abuts end face 41 of the casing 11 and is thereby trapped in inverted seat 27. In this assembly relation, the protective arms' downturned fingers 35 extend slightly into the bores 16, see FIGS. 3 and 4. Since the width W of each downturned finger 35 is only slightly less than the diameter D of its associated bore 16, and since the fingers extend slightly down into the bores 16, the bore closure member 16 cannot rotate with the centerpost 13, i.e., the bore closure member is held stationary, when the latch 12 is rotated between capturing and releasing positions. Note also that the contact surface 35*a* of the protective arms' fingers 35 lie in a common plane 35*b* transverse to the loader's axis 18 when no cartridges are loaded therein, see FIG. 4. This finger contact plane 35*b* is spaced above lower latch groove plane 26*b*', i.e., above the plane 26*b*' transverse to loader axis 18 on which cartridge flanges 21*b* rest, a distance greater then the cartridge flange depth d' so the finger contact surfaces 35*a* do not contact the top surface of the cartridge flanges 21*b* when the loader 10, with full load of cartridges, is upright and motionaless as shown in FIGS. 3 and 3A. For example, and if the cartridge flanges 21*b* are of a 0.055 inch depth, the distance between cartridge flange support plane 26*b*' and finger contact plane 35*b* may be 0.060 inches. Note further that the protective arms' fingers 35 are located on a circular locus of points 38 disposed radially outward (relative to the center axis 18 of the casing 11) of the circular locus of points 19 defined by the casing's bores axes 17 when the loader is viewed from the top or bottom thereof, see FIG. 8. This structural relation insures that no downward force (as represented by phantom force lines 39) will be presented by the fingers 35 on the flanges 21*b* of the cartridges 21 temporarily stored within the loader 10 when the loader is upright and motionless as shown in FIG. 3, and thereby allows a slight drooping of the cartridges' nose ends 21*c* toward the loader's axis 18, i.e., allows the cartridges' axes 21*d* to cant or cock slightly as shown by axis 21*d*' position in FIG. 3A when the loader is upright and motionless, see FIGS. 3 and 3A. The very slight clearance C between the protective arms' contact plane 35*b* and the cartridges flanges 21*b* when the loader is upright and motionless (as shown in FIGS. 3 and 3A) is for purposes explained in greater detail below.

The over center limit stop device 15 restrains the centerpost 13, protective arms 34 and casing 11 in operational relation, and cooperates to define the capturing and releasing positions of the star shaped latch 12 relative to the casing, i.e., cooperates to insure that the latch 12 (and, hence, the centerpost 13) is either disposed in the FIG. 7 attitude or the FIG. 8 attitude, respectively. The limit stop device 15 is particularly illustrated in FIGS. 5 and 6, and includes a spring loaded ball 43 received in longitudinal bore 44 disposed parallel to the casing's axis 18. The device 15 also includes stop pins 45, 46 embedded in the casing 11, and disposed on either side of the ball 43, which cooperate with a cross pin 47 fixed to the centerpost 13 and disposed radially therefrom, see FIG. 6. The relation of the cross pin 47, and the stop pins 45, 46, with the ball 43 is such that, because of the loading of the ball's spring 42, the cross pin 47 (and, hence, the latch 12 and centerpost 13) is disposed in either cartridge capture position shown in FIGS. 6 and 7 or in cartridge release position shown in FIG. 8. The spring 42 bias of the detent ball 43 tends to force the cross pin 47, and thereby rotate the latch 12 and centerpost 13, into either the capture or release position once the cross pin passes the ball's center upon manual rotation of the centerpost through use of the knob 28, thereby establishing an over-center type structure and function.

Use of the first embodiment of the improved cartridge loader is as illustrated in FIGS. 3, 3A, 3B, 4 and 6-8. As shown in FIGS. 4 and 8, the improved cartridge loader is in the release position with the latch 12, i.e., star shaped centerpost section 26*a*, rotated so that star ribs 30 do not intersect or pass into the bores 16 of the casing 11. In this release attitude, therefore, the improved cartridge loader 10 is operationally positioned to receive cartridges 21 within one or more of the six bores 16 defined in the casing, i.e., to permit re-charging of the loader 10. The latch 12 and centerpost 13 are restrained in this releasing position by the over-center stop limit device 15. When it is desired to charge the cartridge loader 10 with cartridges 21, and with the cartridge loader in the FIGS. 4 and 8 or release position, the cartridge loader is inverted and cartridges deposited therein until the cartridges' flanges 21*b* abut the protective arms' fingers 35. In this intermediate loading position, and with the loader 10 still inverted from the upright position shown in FIGS. 1 and 3, the centerpost 13 is manually rotated from that release position shown in FIGS. 4 and 8 to the capture position shown in FIGS. 3 and 7 by use of knob 28. This centerpost 13 rotation causes the star ribs 30 on the latch shaft section 26*a* of the cetnerpost 13 to pass into bores 16 and under the cartridges' flanges 21*b*, i.e., the cartridge flanges 21*b* are trapped or captured in latch groove 26*b*, to prevent the cartridges 21 from falling out of the casing 11 once the now charged cartridge loader 10 is reinverted into the normal or upright position shown in FIG. 3.

It is important to note that, with cartridges 21 captured in latch groove 26*b* and the loader 10 upright as shown in FIG. 3, the cartridges are free to swing or jiggle radially to only a nominal degree in bores 16 because of the limited clearance C established between the protective arms' contact surfaces 35*a* and the cartridges' flanges 21*b*. In other words, the cartridges 21 are free to swing or jiggle radially between inner and outer limits as illustrated by the two phantom line axes 21*d'* and 21*d''* in FIG. 3A. The inner limit shown by phantom line cartridge axis 21*d'*, for each cartridge 21, is defined by contact of the cartridges flange 21*b* with the bores' side wall at bearing point 48 and with the lower lip 26*c* of latch groove 26*b* at bearing point 49, and by contact of the cartridge's shaft 21*a* with star rib 30 at bearing point 50, see solid line cartridge 21 position of FIGS. 3 and 3A. At this inner limit (which constitutes the normal inward drooping position of the cartridge 21 when the loader is upright and motionless as shown in FIG. 3), note particularly that the cartridge shaft 21*a* cannot contact the casing 11, i.e., cannot contact the bore's bottom lip 16*a*, at the casing's bottom face 22; this eliminates noise arising from cartridge shaft 21*a* rattling into and out of contact with the bore's inner bottom lip 16*a*. The outer limit shown by phantom line cartridge axis 21*d''*, for each cartridge 21, is defined by contact of the cartridge's flanges 21*b* with the bore's side wall at bearing point 48 and with the lower lip 26*c* of latch groove 26*b* at bearing point 49, and by contact of the cartridge's flanges 21*b* with contact surface 35*a* of a protective arm's finger 35 at bearing point 51, see phantom line cartridge position of FIG. 3A. At this outer limit (which constitutes the outer jiggle position of the cartridge when the loader is upright and being lightly shaken as shown in FIG. 3A, note further that the cartridge shaft 21*a* cannot contact the casing 11, i.e., cannot contact the bore's outer bottom lip 16*b*, at the casing's bottom face 22; this eliminates noise arising from the cartridge shaft 21*a* rattling into and out of contact with the bore's outer bottom lip 16*b*. Thus, radial inward to radial outward jiggle of the cartridges 21 is controlled. Side-to-side swing or jiggle of the cartridges 21 is similarly controlled through use of the protective arm's finger 35 as the cartridge swings on an axis at its flange 21*b* end defined by bearing points 48, 49, see FIG. 3B. As the cartridge swings side-to-side on bearing point axis 48, 49 between outer limits shown by phantom line in FIG. 3B and represented by phantom line axes 26*d'''* and 26*d''''*, the top surface of the cartridges end flange 21*b* contacts the protective arm's finger 35 (i.e., abuts finger contact surface 35) before the cartridges' shaft 21*a* contacts the bore's bottom lip section 16*c* and 16*d*, respectively. This structure cooperates to eliminate noise arising from the cartridge shaft 21*a* rattling into and out of contact with the bore's opposite side bottom lip section 16*c* and 16*d* when the fully loaded loader is lightly shaken. In other words, the width W of each protective arm 34 is such that it tends to keep the cartridges 21 in line with that bore 16 as the wide finger 35 tends to prevent side-to-side movement of the cartridge within the bore, i.e., tends to return the cartridge to a substantially vertical center line position 21*d* within the bore 16 when viewed as shown in FIG. 3B if the cartridge is disturbed. The structure of this invention, therefore, substantially reduces the rattle noise of lightly shaken fully loaded loader 10 over the rattle noise that occurs when a fully loaded loader of the type shown in U.S. Pat. No. 3,722,125 (referred to earlier) is lightly shaken.

To release the cartridges 21 from captured relation with casing 11, the centerpost 13 (i.e., latch 12) is rotated from the capture or latch position shown in FIGS. 3 and 7 into the release and recharge position shown in FIGS. 4 and 8. When the loader 10 is upright as shown in FIGS. 1 and 3, and with the latch 12 in the FIGS. 4 and 8 release position, the cartridges 21 simply drop downwardly out of the casing due to gravity. This, of course, allows the cartridges 21 to be released from the improved cartridge loader into a revolver's cylinder (not shown in FIGS. 1-8) when that cylinder is properly aligned beneath the cartridge loader, and when the cartridge loader is oriented as shown in FIG. 3, simply through manual rotation of the knob 28 (and, hence, of the latch 12) from the FIGS. 3 and 7 capture attitude into the FIGS. 4 and 8 release attitude.

One advantage of the multiple protective arms 34 being provided in operative combination with the loader's casing 11 and lengthened centerpost latch section 26*a* is, as previously mentioned, that the cartridges 21 so loaded are temporarily stored in substantially non-jiggling or noise free position, yet in a position that allows nominal movement or jiggle. This is because of the clearance C between the cartridges' end flanges 21*b* and the contact surface plane 35*b* of the protective arms' fingers 35 when the cartridge full loader 10 is upright and motionless as shown in FIGS. 3, 3A and 3B, and because of the dimensional relationship between the bore 16 diameter D, latch groove depth d' and star ribs' length L'' that prevents contact of the cartridge shafts 21*a* with the bottom lip 16*a*-16*d* of the casing's bores 16. The substantially noise free or non-jiggling function of this structure, of course, reduces rattling noise which may be undesirable, while the nominal movement or jiggle function of this structure allows the cartridges' nose ends 21*c* to be easily aligned and initially inserted in a revolver's cylinder even if the radius of the revolver's cylinder's bore circle is slightly different from the radius of the loader's bore circle 17. An additional advantage of this structure is that the width W of protective arms 34 provides protection against accidental contact with the cartridges' firing caps 53 in that those protective arms over-lie the firing caps since the casing's bores 16 are open at each end. This, of course, prevents accidental firing of the cartridges if the improved cartridge loader 10 is dropped or otherwise inadvertently contacted against a sharp pointed object. In this same vein, the rigid but resilient protective arm 34 also function as shock absorbers to provide important shock protection if the cartridge loader 10 is dropped or thrown so that it lands against the knob end thereof. In other words, and if the loader 10 is dropped on its knob end when loaded with cartridges, or on the cartridges' nose ends 21*c* when loaded, the protective arms 34 of the improved cartridge loader 10 tend to relieve or dampen the shock pressure on the cartridges by virtue of the resilience function of the arms 34. The resilient but rigid protective arms 34 may be fabricated in a single component part out of, for example, polypropylene or the like, to achieve this resilient but rigid function.

A second embodiment 60 of the improved cartridge loader in accord with the principles of this invention is illustrated in FIGS. 9–13. In this second embodiment structure, the cartridge loader's casing 11, protective arms 34, and limit stop device 15 are identical to that illustrated in FIGS. 1–8 for the first embodiment. Further, the latch 12 and centerpost 13 structure of this second embodiment is identical to the latch and centerpost structure of the first embodiment except for the knob structure 61 thereof. In description of this second embodiment, structural components identical to the same structural components of the first embodiment have been provided with identical reference numbers for purposes of clarity.

Figure 9:
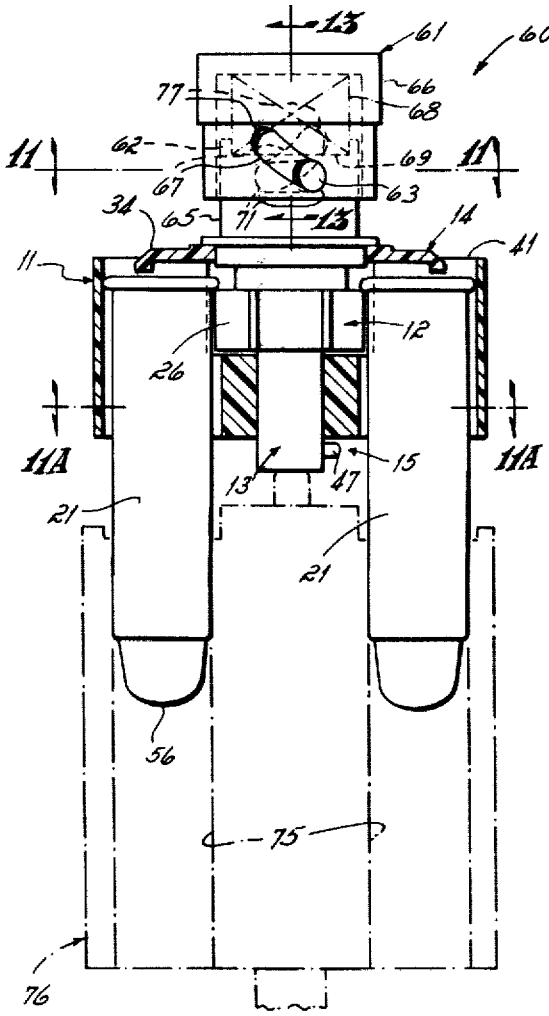
FIG. 9 is a longitudinal cross-sectional view similar to FIG. 3, but illustrating a second embodiment of an improved cartridge loader in accord with the principles of this invention, and showing the loader with a load of cartridges in the cartridge captured or temporary cartridge store position.
Figure 10:
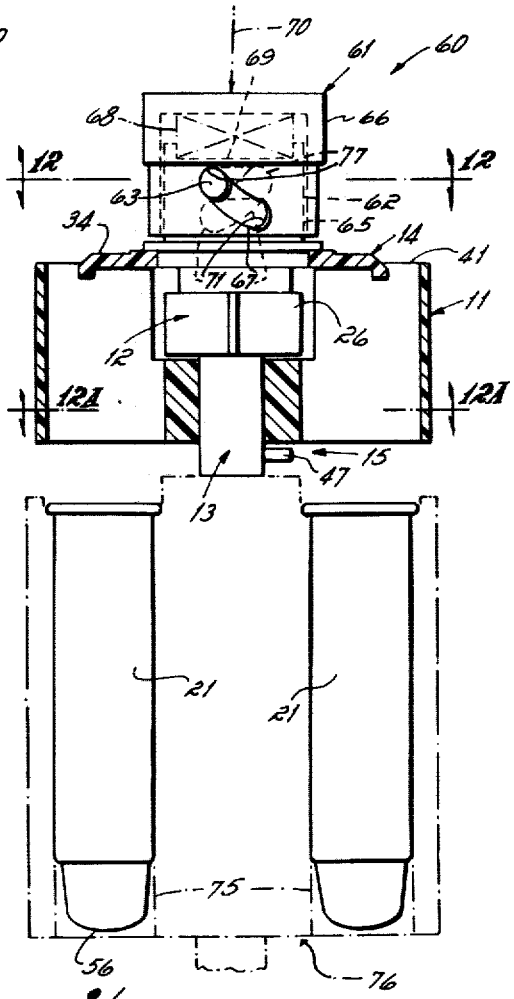
FIG. 10 is a longitudinal cross-sectional view similar to FIG. 7, but of the second embodiment, and showing the loader in the cartridge recharging position.
Figure 13:
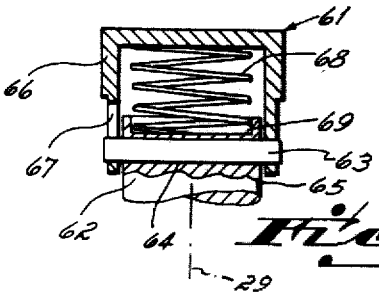
FIG. 13 is a longitudinal cross-sectional view taken along line 13—13 of FIG. 9.

As to the knob structure 61 of the second structural embodiment, same is particularly illustrated structurally in FIGS. 9 and 13. As shown in those figures, the cartridge loader's centerpost 13 is provided with a butt shaft portion 62 that extends upwardly from the top surface 41 of the casing 11. The butt shaft portion 62 of the centerpost 13 is provided with a cam pin 63 transversely disposed relative to the axis 29 of the centerpost, and located in cross bore 64 diametrically formed through that centerpost. The cam pin 63 is of a length that permits same to extend slightly beyond the side surface 65 of the centerpost at each end, see particularly FIG. 13. The cam pin 63 is fixed in position, i.e., is immovable, relative to the centerpost 13. The knob structure 61 includes knob 66 which is of inverted cup shaped configuration. The inverted cup shaped cap 66 defines an inside diameter slightly greater than the outside diameter of the centerpost's butt shaft portion 62, see FIG. 13, thereby permitting the knob 66 to move axially relative to the centerpost 13. The side wall of the cup shaped cap 66, on opposite sides thereof, is provided with two opposed cam slots 67. These cam slots 67 are provided at an angle preferably of about 40° relative to the horizontal when the loader 60 is in the upright position shown in FIGS. 9 and 10. The cam slots 67 are joined in operable combination with the cam pin 63 carried by the centerpost 13, see FIG. 13.

A compression spring 68 is interposed between the top of the centerpost's butt shaft portion 62 and the knob 66, see FIG. 13. The compression spring 62 is oriented in seat 69 defined in the top of the butt shaft portion 62. The compression spring 68 is preferably of a strength that permits the centerpost 13 (and, hence, latch 12) to be rotated manually back and forth between the capture and release positions without compression of the compression spring (i.e., without rotation of knob 66 relative to centerpost 13), by manually gripping the knob 66 and rotating same relative to axis 18. However, the compression spring 68 is preferably also of a strength that permits the spring to be compressed into the FIG. 10 attitude from the FIG. 9 attitude in response to an external force directed axially against the knob 66 toward the casing 11 illustrated by phantom arrow 70. The significance of the strength of the compression spring is apparent upon understanding the use of this second embodiment cartridge loader 60 as described in detail below.

Figure 11:
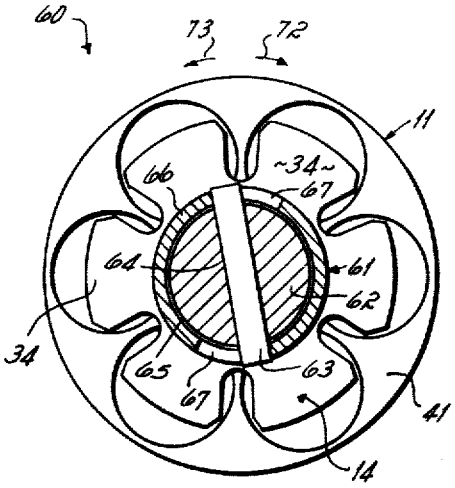
FIG. 11 is a transverse cross-sectional view taken along line 11—11 of FIG. 9.
Figure 12:
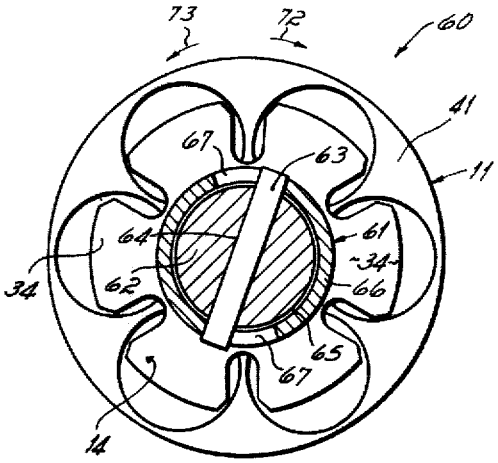
FIG. 12 is a transverse cross-sectional view taken along line 12—12 of FIG. 10.
Figure 11A:
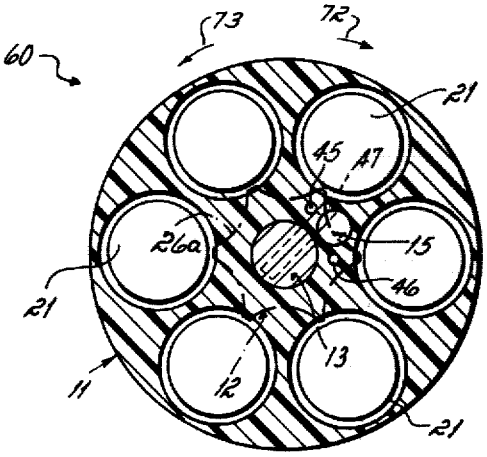
FIG. 11A is a transverse cross-sectional view taken along line 11A—11A of FIG. 9.
Figure 12A:
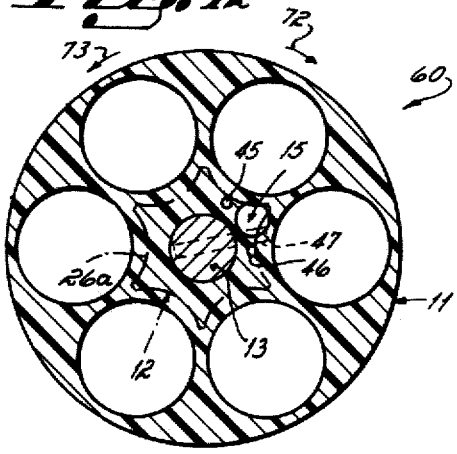
FIG. 12A is a transverse cross-sectional view taken along line 12A—12A of FIG. 10.

In use of the second embodiment of the improved cartridge loader 60, the fully loaded position of the cartridge loader, with cartridges 21 temporarily stored therein, is illustrated in FIGS. 9, 11 and 11A. As shown in those figures, the cartridges 21 are retained within the loader casing 11 through cooperation of star shaped centerpost section 26*a* and casing bores 16 in the same manner as described above in connection with the first embodiment of the loader 10. Furthere, and importantly, in the normal position the spring 68 loaded knob 66 is biased longitudinally away from the casing 11 so that cross pin 63 is bottomed out against bottom ends 71 of the cam slots 67. In this attitude of the knob 66, the knob (and, therefore, the centerpost 13 and latch 12) is readily manually rotatable into the capture or latch position from the release position, i.e., counter-clockwise as shown by arrow 73, until the limit stop device's cross pin 47 abuts that device's stop pin 45 because of the compressive strength of the compression spring 68 when that spring is of the preferred strength as described above. In other words, the knob's cam slots 67 do not ride over the camp pin 63 in this counter-clockwise rotation because the compressive strength of the compression spring precludes relative rotation (and relative axial motion) between the knob 66 and the centerpost 13. Also, the knob 66 (and, therefore, the latch 12 and centerpost 13) is rotatable in the clockwise direction as shown by arrow 72 from the capture position (FIGS. 9 and 11) to the release position (FIGS. 10 and 12) by manually gripping the knob 66 and so rotating it clockwise 72 until the limit stop device's cross pin 47 abuts that device's stop pin 45 because the cam pin 63 is bottomed out against the bottom ends 71 of the cam slots 67 on that knob 66. Thus, and importantly relative to this second embodiment, the latch 12 (and centerpost 13) is manually rotatable from the release position (FIGS. 10 and 12) to the latch position (FIGS. 9 and 11), and is also manually rotatable from the latch position back to the release position, so as to permit manual operation of the second embodiment loader 61 in exactly the same manner described above in connection with the first embodiment loader 10 if desired by the user.

The second embodiment of the improved cartridge loader 60 is also usable in semi-automatic fashion when it is desired to unload that loader. In this semi-automatic use mode, the casing 11 of loader 10 is so restrained against rotation. In practice, that casing 11 of loader 10 is so restrained by positioning the cartridges 21 partially into the chambers 75 of a revolver's cylinder 76; the combination of the cylinder 76 and cartridges 21 precludes rotation of the cartridge loader's casing 11 when the cylinder is manually restrained against rotation. This preliminary step is illustrated in FIG. 9, and after this preliminary step, the cartridges 21 are disposed above the revolver's cylinder 76 relative to ground level so that same may drop by gravity into the revolver chamber when released from the cartridge loader 60. Semi-automatic release of the cartridges 21 from the improved cartridge loader 60 is achieved by directing an external manual force 70 axially of the cartridge loader against the knob 66 while simultaneously preventing rotation of the knob 66 and the revolver cylinder 76 (and, hence, the casing 11); such is easily accomplished by hand.

The axial force 70, and simultaneous restraining of knob 66 and casing 11 against rotation, causes the latch 12 and the centerpost 13 to rotate relative to the casing 11 as cam pin 63 is forced up cam slots 67 to the top ends 77 of those cam slots 67. In other words, and as the longitudinal or axial force 70 is manually exerted externally on the knob 66, and when the knob 66 and casing 11 (through revolver cylinder 76) is simultaneously and manually prevented from rotating by the user's hands, the latch 12 and centerpost 13 are caused to rotate from the capture attitude illustrated in FIGS. 9 and 11 to the release attitude illustrated in FIGS. 10 and 12. The release position is defined in this operational mode by cam pin 63 topping out against the top ends 77 of the cam slot 67, and the latch 12 and centerpost 13 are thereafter maintained in that release position after release of the knob 66 through abutment of the limit stop device's cross pin 47 with that device's stop pin 45. The length of the cam slots 67 is controlled so that the knob 66 bottoms out only at bottom end 71 of the slots 67. Without the casing 11 being restrained against rotation, both the centerpost 13 and the casing 11 would rotate in response to axial force 70, thereby defeating the cartridge release objective. But since the cartridges 21 carried in the casing 11 are partially received in the revolver's cylinder 76 as illustrated in FIG. 11, and since the revolver's cylinder is held stationary by the user's other hand in the gun loading or charging sequence, the improved loader's casing 11 is thereby also retained in a stationary attitude relative to the revolver's chamber. This operative sequence permits the cartridges 21 to drop from the loader 60 into the revolver's cylinder as the latch 12 is moved from the FIGS. 9 and 11 capture position to the FIGS. 10 and 12 release position in response to the axial force 70 exerted on the knob 66, while preventing rotation of the knob and casing 11, so as to cause functional operation of the cam pin 63 and cam slots 67.

The structure of this second embodiment 60 of the improved cartridge loader possesses certain advantages over prior art cartridge loader structures which also provide a semi-automatic unloading step sequence. In the first instance, if the cartridge loader 60 is inadvertently dropped on the knob 66, the cartridges 21 carried in the loader will not release from the casing 11, i.e., from the loader, because the knob will rotate relative to the center shaft 13 as permitted by spring 68. In other words, and because of the compression spring 68, if the loader 60 is dropped on the knob 66 the cartridges 21 do not release because the knob is allowed to turn relative to the centerpost 13 against the bias of the spring 68. Furthermore, it is impossible to effect release of the cartridges 21 by dropping the cartridge loader 60 on the cartridges' ends 56, or by subjecting the loader's casing 11 or centerpost 13 to any force on the bottom face thereof, thereby further enhancing the safety aspect of this cartridge loader embodiment.

Figure 14:
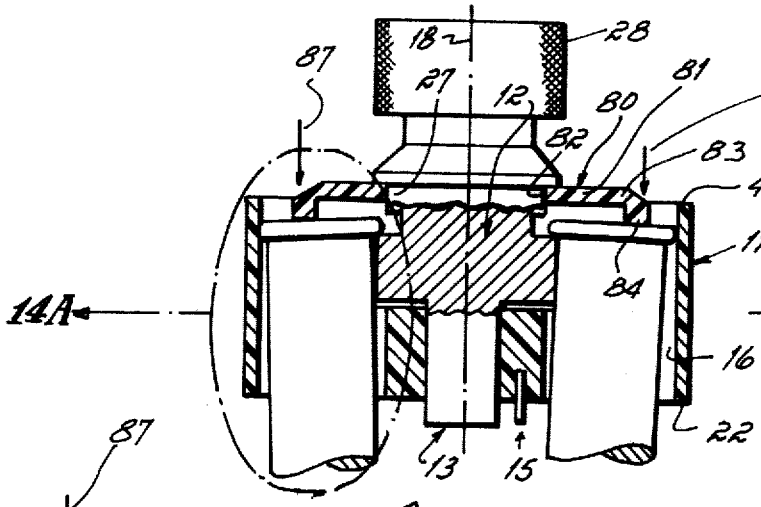
FIG. 14 is a longitudinal cross-sectional view similar to FIGS. 3 and 9, but illustrating a third embodiment of an improved cartridge loader in accord with the principles of this invention, and showing the loader with a load of cartridges in the stored position.
Figure 14A:
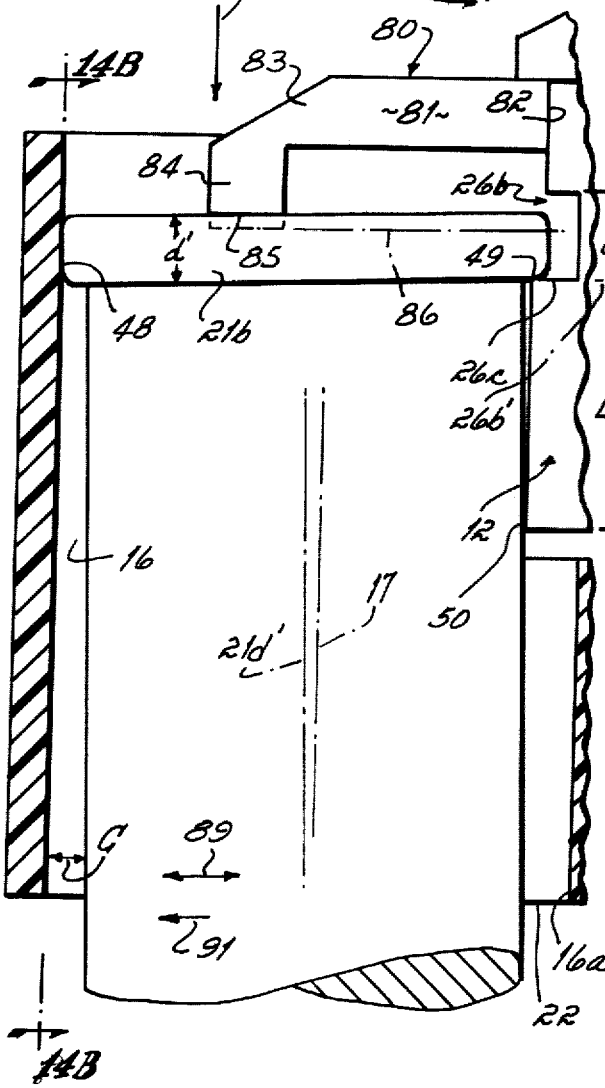
FIG. 14A is an enlarged view of encircled portion 14A of FIG. 14.
Figure 14B:
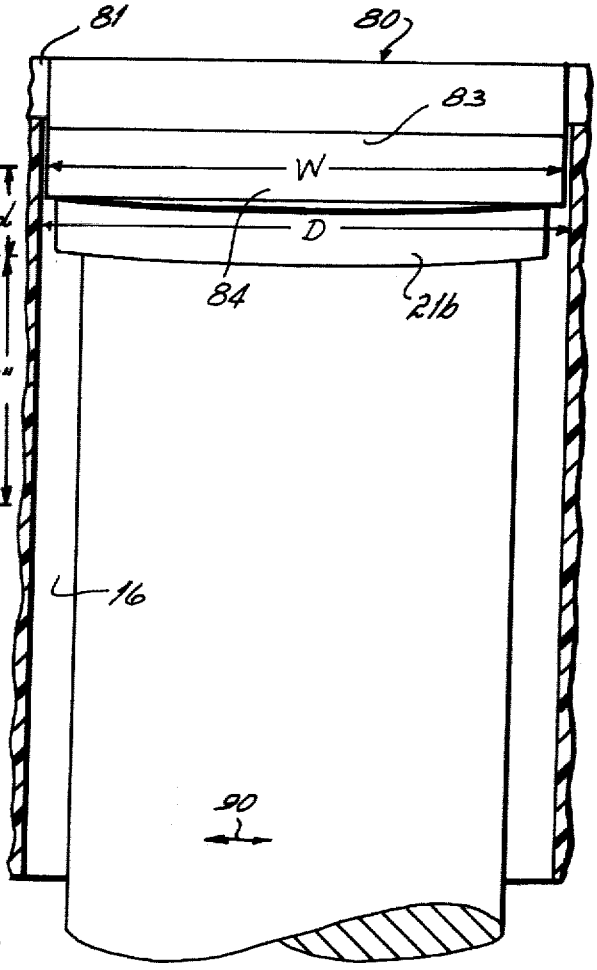
FIG. 14B is a cross-sectional view taken along lines 14B—14B of FIG. 14A.

A third embodiment of an improved cartridge loader in accord with the principles of this invention is illustrated in FIGS. 14, 14A and 14B. In this third embodiment structure, the cartridge loader's casing 11 is identical to that illustrated in FIGS. 1–8 for the first embodiment. Further, the cartridge loader's latch 12 and centerpost 13 structure, as well as limit stop device 15 and knob 28, of this third embodiment are identical to the latch 12, centerpost 13, limit stop device 15 and knob 28 of the first embodiment. The difference between this third embodiment and the first embodiment is found in the structural configuration and function of the resilient bore closure member 80 which is primarily illustrated in FIGS. 14, 14A and 14B. But the structural configuration of the third embodiment's bore closure member 80 is the same as the structural configuration of the first embodiment's bore closure member 14 when viewed in top or bottom views so that FIGS. 2 and 6–8 are also relevant in understanding the loader's third embodiment. In description of this third embodiment, structural components identical to the same structural components of the first embodiment have been provided with identical reference numbers for purposes of clarity.

In the third cartridge loader embodiment, the resilient but stationary bore closure member 80 includes a member 81 with central bore 82 sized to permit interengagement of that member 80 with inverted seat 27 on the centerpost 13. The fit between the bore closure member's central bore 82 and the centerpost 13 is a slip fit, and is sized to permit rotation of the centerpost relative to that member 80. The bore closure member 80 is comprised of a number of resilient protective arms 83 equal to the number of cartridge bores 16 in the casing 11. The protective arms 83 are defined in the one-piece bore closure member 80 to extend outwardly from washer section 81 so as to permit substantially independent resilience or flex action of each arm relative to the bore 16 served by that arm. Note the washer section 81 abuts end face 41 of the casing 11 (similar to that shown for washer section 36 in the first embodiment's bore closure member 14 as shown in FIG. 5), and is thereby trapped in inverted seat 27. In this assembled relationship with the casing 11, the protective arms' downturned fingers 84 extend into the casing's bores 16. Since the width W of each downturned finger is only slightly less than the diameter D of its associated bore 16 (see FIGS. 2 and 14B), and since the fingers extend slightly down into the bores, the bore closure member 80 cannot rotate with the centerpost 13, i.e., the bore closure member is held stationary, when the latch 12 is rotated or moved between capturing and releasing positions. The contact surfaces 85 of the protective arms' fingers 84 lie in a common plane 86 transverse to the loader's axis 18 when no cartridges are loaded therein, see phantom line position of the fingers as shown in FIG. 14A. This finger contact plane 86 is spaced above lower latch groove plane **26*b*', i.e., above the plane 26*b*' transverse to loader axis 18 on which cartridge flanges 21*b* rest, a distance lesser than the cartridge flange depth d' so the finger's contact surfaces 85 always contact the top surfaces of the cartridge flanges 21*b* when the loader 10, with a full load of cartridges, is upright and motionless as shown in FIGS. 14, 14A and 14B. For example, and if the cartridge flanges 21***b* are of a 0.055 inch depth, the distance between cartridge flange support plane 26*b*' and finger contact surface plane 86 may be 0.050 inches when no cartridges 21 are loaded in the loader. Further, and as with the first embodiment, the protective arms' fingers 84 are located on a circular locus of points 38 disposed radially outward (relative to the center axis 18 of the casing 11) of the circular locus of points 19 defined by the casing bores' axes 17 when the loader is viewed from the top or bottom thereof, see FIG. 8. This structural relation insures that a downward spring type or resilient force (as represented by force lines 87) will be presented by the protective arms' fingers 84 on the flanges 21*b* of the cartridges 21 temporarily stored within the loader 10 when the loader is upright and motionless as shown in FIG. 14A. This spring or resilient force 87 insures a slight drooping of the cartridge's nose ends (not shown) toward the loader's axis 18, i.e., forces the cartridges' axes 21*d* to cant or cock slightly as shown in FIG. 14A when the loader is upright and motionless. The spring type downward contact provided by this geometry between the protective arms' fingers 84 against the cartridges flanges 21*b* when the loader is upright and motionless (as shown in FIG. 14) is for purposes explained in greater detail below. Preferably the resilient closure member 80 is fabricated of an inherently resilient material, e.g., polyethylene, of a one-piece configuration.

Use of this third embodiment of the improved cartridge loader is the same as use of the first embodiment of the improved cartridge loader. However, and with cartridges captured in latch groove 26*b* and the loader 10 upright, as shown in FIG. 14, the cartridges are not free to swing or jiggle within the casing's bores 16 when the loader is upright and being lightly shaken. This for the reason that there is no clearance between the protective arms' contact surfaces 85 and the cartridge's flanges 21*b* because of the spring or resilient force 87 exerted by the protective arms 83 against the cartridge flanges when the cartridges 21 are in the loaded position and the loader is upright as shown in FIG. 14, the cartridges are not free to swing or jiggle within the casing's bores 16 when the loader is upright and being lightly shaken. This for the reason that there is no clearance between the protective arms' contact surfaces 85 and the cartridge's flanges 21*b* because of the spring or resilient force 87 exerted by the protective arms 83 against the cartridge flanges when the cartridges 21 are in the loaded position and the loader is upright as shown in FIGS. 14, 14A and 14B. In other words, each cartridge 21 is retained in that position shown in FIGS. 14, 14A and 14B by the spring force 87 exerted by the resilient but stationary bore closure member 80 by forcing the cartridge's flange 21*b* against a bore's side wall at bearing point 48, by forcing the cartridge's flange 21*b* against the lower lip 26*c* of latch groove 26*b* at bearing poing 49, and by forcing the cartridge's shaft 21*a* against star rib latch 12 at bearing point 50. In this loaded position, note particularly that the cartridge shaft 21*a* cannot contact the loader's casing 11, i.e., cannot contact the bore's bottom lip 16*a*, at the casing's bottom face 22; this eliminates noise arising from cartridge shaft 21*a* rattling into and out of contact with the bore's inner bottom lip 16*a*. Indeed, the resilient force 87 provided by resilient protective arms 83 prevents any rattle whatsoever of cartridges 21 within the loader's casing 11 when the loader is upright and lightly shaken because of the three point suspension 48–50 in which each cartridge 21 is held by the resilient bore closure member 80. Thus, radial inward to radial outward jiggle (shown by double arrow 89 in FIG. 14A) of the cartridges 21 within the loader's bore 16 is eliminated. Further, side-to-side swing or jiggle (shown by double arrow 90 in FIG. 14B) of the cartridges 21 within the loader's bores is similarly eliminated because the protective arms' fingers 84 contact the cartridge flanges 21*b* throughout the width of the bore as shown in FIG. 14B.

One advantage of the plural protective arms 83 in operative combination with the loader's casing 11 and lengthened centerpost latch section 26*a* is, as previously mentioned, that the cartridges 21 so loaded are temporarily stored in a non-jiggling or noise free position. This is because resilient forces 87 are exerted against the cartridges' flanges 21*b* by the protective arms' fingers 84 when the cartridges are loaded within the loader in light of the dimensional relationship between the bore 16 diameter D, latch groove depth d, star ribs' length L'' and the position of fingers' contact plane 86 when no cartridges 21 are in the loader. However, the resilient natture of the protective arms 83 also provides a second significant advantage in this third embodiment in that same permits nominal movement of the cartridges' nose ends against that resilient force in a radially outward direction shown by phantom arrow 91 if required when loading a gun's chamber. In other words, and for example, even if the radius of the revolver cylinder's bore circle is slightly different from the radius of the loader's bore circle 19 interaction of the cartridge's nose ends with the revolver's cylinder bores will cause the cartridges to be slightly cammed outwards in direction of phantom arrow 91 against the downward resilience 87 of the protective arms 83 to permit easy alignment and insertion of those cartridges into the revolver's cylinder. The movement permitted in this regard is limited to the clearance C between the cartridge's shaft 21*a* and the loader casing's bore 16 at the bottom lip 16*a* of that bore. A further advantage of this structure is that the width W of protective arms 83 provides protection against accidental contact with the cartridges' firing caps 53 as is the case also with the resilient bore closure member 14 shown in the first embodiment. Also, the bore closure members 80 of this embodiment can function as shock absorbers to provide shock protection if the loader 10 is dropped or thrown so that it lands against the knob 28 or against the cartridges' noses.

What I claim:

1. An improved cartridge loader comprising a generally star shaped latch on a shaft, said shaft being rotatably carried within a casing, said latch cooperating with a plurality of cartridge bores defined by said casing and positioned circumferentially around said latch, said latch being selectively movable between a capture position at which cartridges are latched in temporarily stored relation with said loader and a release position at which cartridges temporarily stored within said loader are released therefrom, and a resilient bore closure member seated on said shaft and rotatable relative thereto, said bore closure member being comprised of a plurality of resilient protective arms each of which is at least partially received within a casing bore, each of said protective arms including a contact surface adapted to cooperate with a cartridge's end flange when said loader is loaded with cartridges, and at least one of said protective arms being of a width that prevents substantial rotation of said closure member relative to said casing as said latch moves between said capture and release positions.

2. An improved cartridge loader as set forth in claim 1, said contact surfaces being out of contact with said cartridges' end flanges when a cartridge loaded loader is oriented upright and motionless, said contact surfaces and said latch and said bores' walls cooperating with said cartridges to minimize rattling of said cartridges' shafts against said casing bores' bottom lips when said loader is upright and lightly shaken for minimizing noise, but also cooperating with said cartridges to allow a nominal unopposed movement of said cartridges' nose ends if necessary for aid in loading a gun's chamber.

3. An improved cartridge loader as set forth in claim 1, said contact surfaces being in contact with said cartridges' end flanges when a cartridge loaded loader is oriented upright and motionless, said contact surfaces and said latch and said bores' walls cooperating with said cartridges to eliminate rattling of said cartridges' shafts against said casing bores' bottom lips when said loader is upright and lightly shaken for minimizing noise, but also cooperating with said cartridges' nose ends against the resilience of said protective arms if necessary for aid in loading a gun's chamber.

4. An improved cartridge loader as set forth in claim 2 or 3, said bore closure member further including a common washer section to which said protective arms are connected, said washer section and protective arms being of a one-piece structure.

5. An improved cartridge loader as set forth in claim 4, said star shaped latch comprising a plurality of ribs extending parallel to the axis of said loader, and a latch groove located above said ribs, each rib having an axial length sufficient that a cartridge bearing point is established at the bottom of a rib, on the side wall of said casing, and in said latch groove, said bearing points cooperating with said protective arms.

6. An improved cartridge loader as set forth in claim 1, each protective arm comprising a contact finger which defines said contact surface, said fingers collectively cooperating to define a circular contact locus radially outward of the cartridge bores' circular center axes locus to cooperate with said cartridges' end flanges radially outward of the center axes of said cartridges when said cartridges are retained in said bores.

7. An improved cartridge loader as set forth in claim 6, each protective arm being structured and configured to overlie each cartridge's head so as to prevent accidental contact with each cartridge's firing button if the loader is accidentally dropped.

8. An improved cartridge loader comprising a generally star shaped latch rotatably carried within a casing, said latch cooperating with a plurality of cartridge bores defined by said casing and positioned circumferentially around said latch, said latch being selectively movable between a capture position at which cartridges are latched in temporarily stored relation with said loader and a release position at which cartridges temporarily stored within said loader are released therefrom, and said casing being of a length such that said cartridges would rattle against the bottom lips of said casing bores when in stored relation if not prevented from doing so, and a resilient bore closure member connected with said casing, said reilient bore closure member being comprised of a plurality of resilient protective arms each of which overlies a casing bore and defines a contact surface adaped to cooperate with a cartridge's end flange when a cartridge loaded loader is oriented upright and motionless, said contact surfaces and said latch and said bores' walls cooperating with said cartridges to prevent rattling of said cartridges' shafts against said casing bores' bottom lips when said loader is oriented upright and lightly shaken, and also cooperating with said cartridges to allow nominal movement of said cartridges' nose ends if necessary when loading a gun's chamber.

9. An improved cartridge loader as set forth in claim 8, said contact surfaces being out of contact with said cartridges' end flanges when a cartridge loaded loader is oriented upright and motionless, said contact surfaces and said latch and said bores' walls cooperating with said cartridges to minimize rattling of said cartridges' shafts against said casing bores' bottom lips when said loader is upright and lightly shaken for minimizing noise, but also cooperating with said cartridges to allow a nominal unopposed movement of said cartridges' nose ends if necessary for aid in loading a gun's chamber.

10. An improved cartridge loader as set forth in claim 8, said contact surfaces being in contact with said cartridges' end flanges when a cartridge loaded loader is oriented upright and motionless, said contact surfaces and said latch and said bores' walls cooperating with said cartridges to eliminate rattling of said cartridges' shafts against said casing bores' bottom lips when said loader is upright and lightly shaken for minimizing noise, but also cooperating with said cartridges to allow movement of said cartridges' nose ends against the resilience of said protective arms if necessary for loading a gun's chamber.

11. An improved cartridge loader as set forth in claims 9 or 10, said bore closure member further including a common washer section to which said protective arms are connected, said washer section and protective arms being of a one-piece structure.

12. An improved cartridge loader as set forth in claim 11, said star shaped latch comprising a plurality of ribs extending parallel to the axis of said loader, and a latch groove located above said ribs, each rib having an axial length sufficient that a cartridge bearing point is established at the bottom of a rib, on the side wall of said casing, and in said latch groove, said bearing points cooperating with said protective arms.

* * * * *